US005090671A

United States Patent [19]

Gombault et al.

[11] Patent Number: 5,090,671

[45] Date of Patent: Feb. 25, 1992

[54] METHOD AND DEVICE FOR FOLDING SHEETS

[75] Inventors: Jacobus F. Gombault, Drachten; Gerhard Hidding, Heerenveen, both of Netherlands

[73] Assignee: Hadewe B.V., Drachten, Netherlands

[21] Appl. No.: 593,876

[22] Filed: Oct. 5, 1990

[30] Foreign Application Priority Data

Oct. 5, 1989 [NL] Netherlands ..... 8902476

[51] Int. Cl.[5] ..... B42C 1/00

[52] U.S. Cl. ..... 270/45; 270/47; 493/419; 493/444

[58] Field of Search ..... 270/32, 45, 47; 493/419, 420, 444, 445, 437, 442, 460, 461, 451, 435

[56] References Cited

U.S. PATENT DOCUMENTS

| | | | |
|---|---|---|---|
| 3,572,688 | 3/1971 | Mazzolla | 493/419 |
| 4,279,611 | 7/1981 | Labombarde | 493/419 |
| 4,781,367 | 11/1988 | Stab | 270/45 |
| 4,985,013 | 1/1991 | van der Werff | 493/444 |
| 4,995,600 | 2/1991 | Kovac | 270/45 |

FOREIGN PATENT DOCUMENTS

| | | | |
|---|---|---|---|
| 134471 | 6/1988 | Japan | 270/32 |

*Primary Examiner*—Edward K. Look
*Assistant Examiner*—Therese M. Newholm
*Attorney, Agent, or Firm*—Burns, Doane, Swecker & Mathis

[57] ABSTRACT

Method and device for folding pliable material. Arranged approximately on opposite sides of a feeding plane and directly opposite each other are folding rollers. The starting point is a position of the pliable material where a portion of the pliable material is in the feeding plane and a portion is bent out of that plane. An arcuate poriton of the portion of the pliable material that is bent out of the plane is folded over and conducted to a folding/nipping area between the folding rollers by pressing that portion at at least one location against the proximal folding roller and rotating this folding roller. A trailing portion of the pliable material is fed from the feeding plane in a controlled fashion. The folding rollers then make the fold. The invention enables accurate control of the location where the fold is made and the exertion of a relatively small force is sufficient for the pliable material to be conducted into the folding nip. The trailing portion of the pliable material passes through the folding device without being substantially bent.

18 Claims, 2 Drawing Sheets

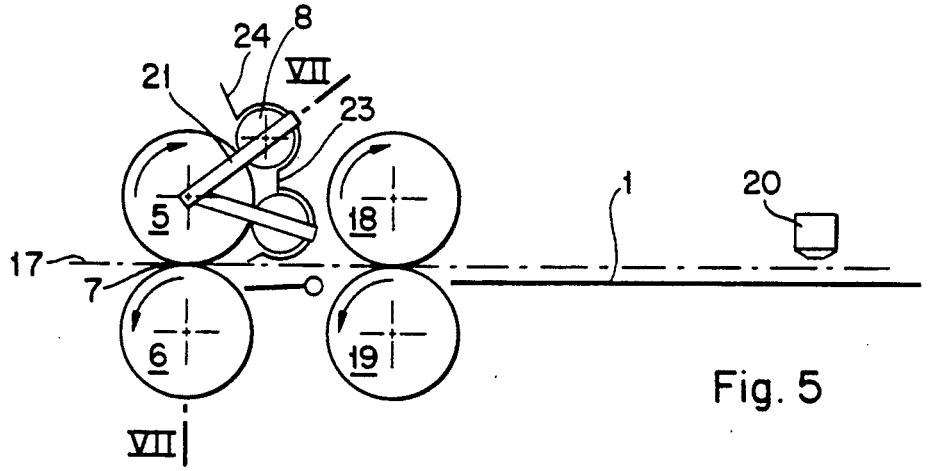
Fig. 5
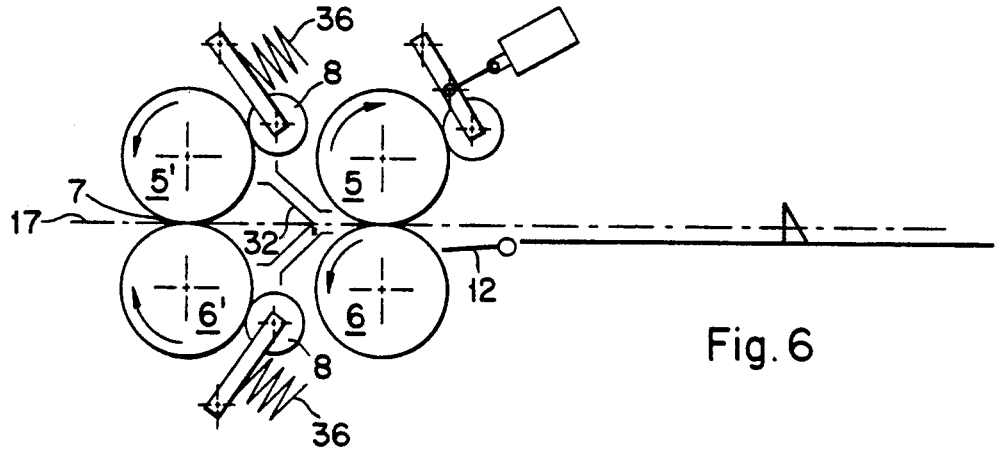
Fig. 6
Fig. 7
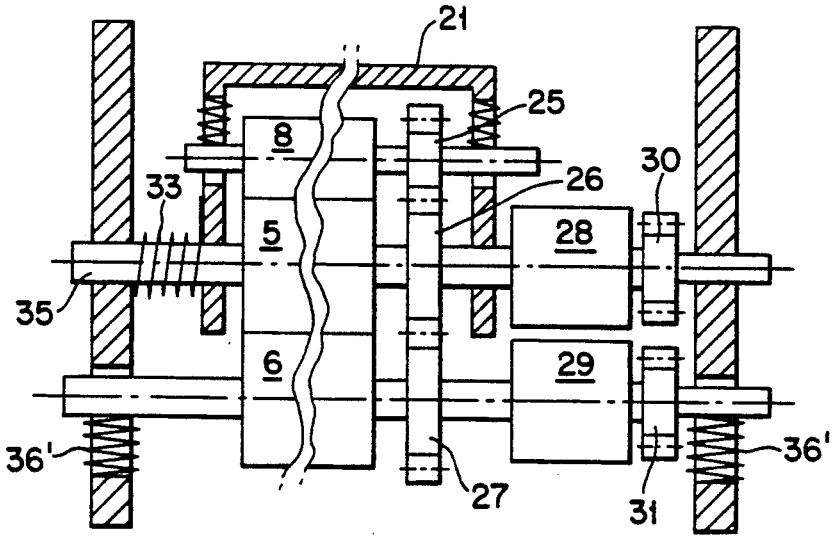

METHOD AND DEVICE FOR FOLDING SHEETS

BACKGROUND OF THE INVENTION

The invention relates to a method of folding pliable material in the form of assembled or single sheets of paper or similar relatively rigid material which may vary in quality and length, the folding taking place by means of folding rollers arranged approximately diametrically opposite to each other, substantially on either side of a feeding plane, starting from a position of the pliable material in which a part thereof lies in the feeding plane and a part is bent out of said plane and wherein an arcuate part of the portion of the pliable material bent out of the plane is bent further and is conducted to a folding/nipping area between the folding rollers where the folding rollers make the fold and wherein a trailing portion of the pliable material is fed in controlled fashion from the feeding plane.

Such a method is known from Dutch laid-open patent application 8702456. In this method the curve of the portion of the pliable material that is bent out of the feeding plane is rendered more acute by pressing a so-called folding knife against it until the bent portion has a small radius and is pressed between the folding rollers The portion pressed between the folding rollers and, subsequently, the remaining portions of the pliable material are conducted through the folding nip by the folding rollers, so that the fold is made. This folding method can be used very universally. The position of the fold can be accurately set relatively to the trailing edge of the pliable material and the position of the folding line can be readily changed by chosing a different length for the portion bent out of the feeding plane in the above mentioned starting position of the pliable material. A set of pliable material, comprising stacked sheets of different size, can be folded as a whole, and the trailing portion of the pliable material fed from the feeding plane, in which no fold is to be made, may comprise relatively rigid material, such as cardboard or plastic, in virtue of the fact that the trailing portion of the pliable material traverses a substantially straight path during folding.

A problem involved in such a method, however, is the magnitude of the force required to press the knife against the pliable material for the pliable material to be folded accurately. In particular this is the case when thicker stacks of sheets are being folded, consisting, for example, of eight sheets on top of each other. Further, the knife must be controlled with great precision and it forms a long lever whose free end exerts a pressure. Such great forces to be exerted by and on the knife and the accurate control of the knife require a robust construction of the knife and its suspension, and, on account of the great mass of the construction, a great power for driving the operations of the knife. As a result, this method can only be carried out by means of an expensive, powerful and heavily-built machine.

The invention aims to overcome the above mentioned problems while retaining the advantages of the known method referred to.

SUMMARY OF THE INVENTION

This object is accomplished in accordance with the invention in virtue of the fact that the arcuate part of the pliable material is bent further and conducted to the folding/nipping area between the folding rollers by pressing the portion of the pliable material bent out of the feeding plane in at least one place against the closest folding roller and rotating said folding roller.

By the rotation of the folding roller, against whose outer surface the portion of the pliable material bent out of the supply plane is pressed, the radius of the curve of that bent portion of the pliable material is reduced and that portion of the pliable material is pressed against the folding rollers at the location of the folding nip. When the curved portion is carried between the folding rollers to a sufficient extent and is pressed against the folding rollers, it is carried along by the folding rollers and conducted through the folding/nipping area, the fold thus being formed.

Owing to the fact that the pliable material, to prevent it from sliding along the folding roller, is kept fixated in the vicinity of the folding/nipping area, an accurate control of the formation of the curve with the reduced radius is achieved and, accordingly, an accurate control of the position of the fold. The forces required to further bend the portion of the pliable material that is bent out of the feeding plane are relatively small in virtue of the fact that when the portion bent out of the feeding plane is further bent, portions thereof are pressed towards each other.

Pressing the pliable material against one of the folding rollers can be effected by means of a hold-down roller. This offers the advantage that the position of the hold-down element may, in circumferential direction relative to the folding roller, be independent of the rotation of that folding roller.

The hold-down roller can be permanently pressed towards the folding roller, so that no provisions are necessary for lifting the hold-down roller off the outer surface of the folding roller.

Before it is clamped against the folding roller, the pliable material can also be displaced relatively to the outer surface of that folding roller, so that the desired starting position of the pliable material can be achieved independently of the instantaneous direction of rotation of the folding roller.

The hold-down roller which is pressed towards the folding roller can be driven by means other than the outer surface of the folding roller, at a peripheral velocity which is equal to the peripheral velocity of the folding roller. Thus, sheets can be prevented from sliding relatively to each other, in particular in the case of pliable material consisting of greater numbers of sheets.

Accurate control of the position where the fold is made is accomplished in virtue of the fact that the area where the pliable material is clamped against the folding roller when the arcuate portion of the pliable material is further bent and fed between the folding rollers is pivoted about the axis of rotation and in the direction of rotation of the folding roller. The pliable material is retained between the folding roller and the hold-down element close to that location.

Such portions of the part of the pliable material that is bent out of the feeding plane as are folded away from the folding roller can be guided to the folding/nipping area by means of guide means which pivot along with the area where the pliable material is clamped against the folding roller. Thus, those parts of the pliable material that are already folded over can be prevented from being pressed towards the pliable material so that upon their passage between the folding rollers they do not unfold or are double-folded in undesirable locations.

The controlled feeding of the trailing portion can be accomplished by pushing against the trailing edge of the pliable material, with the location of said trailing edge being signalled to a control system, which starts the further bending and feeding of the bent portion between the folding rollers depending on the location of said trailing edge and the required distance between said trailing edge and the fold. By the operation of this control system the location on the pliable material where the fold is made can then be set very readily and optionally automatically.

According to an alternative embodiment of the invention, the location on the pliable material where the fold is made can be set very readily and optionally automatically in virtue of the fact that a portion of the pliable material contiguous to the trailing edge is driven by means of coacting rollers on opposite sides of the pliable material, while the angular displacement of the rollers is signalled to a control system, which starts the further folding over and conducting of the bent portion between the folding rollers, depending on the location of the said trailing edge and the required distance between the said trailing edge and the fold.

For several mutually parallel folds to be made in the pliable material, with portions of the material to be folded being folded over in successive directions to be randomly determined, after the first fold at least one subsequent fold can be made, with the direction in which the leading portion of the pliable material is folded over relatively to the trailing portion of the pliable material being determined by the bending of said leading edge and a contiguous portion of the pliable material out of the feeding plane in a direction corresponding with the folding over direction, while the direction in which the leading edge and the contiguous portion of the pliable material are bent out of the feeding plane is determined by bringing a guide member in a position in which it intersects the feeding plane obliquely in the folding over direction, as viewed in the direction of transport.

The invention also relates to a folding device for folding pliable material in the form of assembled or single sheets of paper or similar relatively rigid material, which may vary in quality and length, comprising a feeding plane for the pliable material, at least one pair of folding rollers arranged approximately diametrically opposite each other, substantially on either side of the feeding plane, said folding rollers having opposite outer surface portions forming a folding/nipping area in a position substantially in the feeding plane, a movable feeding guide adapted to intersect the feeding plane, and means for bending and conducting a bent portion of the pliable material towards the folding/nipping area.

According to the invention, the means for conducting the bent portion of the pliable material towards the folding/nipping area are formed as at least one hold-down element adapted to exert a pressure force on one of said folding rollers.

Thus the invention provides a device which can be used for carrying out the method according to the invention and which may be of relatively light construction.

THE DRAWINGS

The invention will now be further explained and illustrated with reference to a number of embodiments as shown in the accompanying drawings, in which FIGS. 1–4 are schematic representations of side-elevational views of a device according to the invention in successive stages of the processing of a sheet.

FIGS. 5 and 6 are schematic side-elevational views of further embodiments of the invention; and FIG. 7 is a schematic sectional view taken on the line VII—VII of FIG. 5.

DETAILED DESCRIPTION OF PREFERRED EMBODIMENTS OF THE INVENTION

Figure 1:
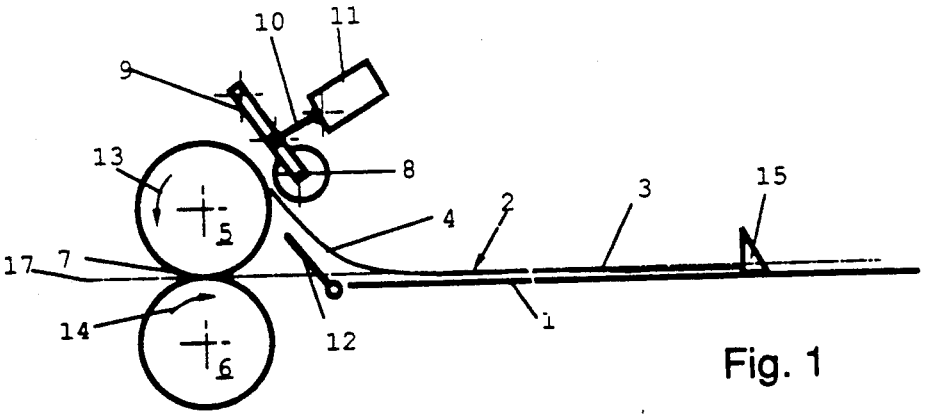

The embodiment of the invention shown in FIG. 1 comprises a pliable material table 1 for supporting a portion 3 of the pliable material 2 in a position at least approximately in the feeding plane 17. A portion 4 of the pliable material 2 is bent out of the feeding plane 17. The portion 4 of the pliable material 2 rests against an upper folding roller 5. Arranged opposite the upper folding roller 5 is a lower folding roller 6. Rollers 5 and 6 are arranged on opposite sides of the feeding plane 17 and opposite outer surface portions of the folding rollers 5 and 6 form a folding nip 7 disposed in the feeding plane 17. Arranged on the supply side opposite a segment of the upper folding roller 5, remote from the feeding plane 17, is a hold-down element which is formed as a hold-down roller 8. The hold-down roller 8 is suspended by means of a rocker 9, a control rod 10 engaging the rocker 9, which rod in turn is connected to an electromagnet 11. The hold-down roller 8 is shown in FIG. 1 as being in a position where it is lifted off the upper folding roller 5. Arranged between the pliable material table 1 and the folding nip 7 is a feeding guide 12 in a position where it intersects the feeding plane 17, in which position the feeding guide 12 can be used for guiding the pliable material 2 to a starting position as shown in FIG. 1. The folding rollers 5 and 6 rotate in the direction as shown by the arrows 13 and 14. The edge of the pliable material 2 which is remote from the folding nip 7 abuts against a slide 15.

Because the hold-down roller 8 is lifted off the folding roller 5, optionally further pliable material can be added to the pliable material 2, without the folding roller 5 engaging the pliable material resting against it. Because the hold-down roller 8 is lifted off the folding roller 5, no provisions are required for interrupting the drive of the folding roller 5, for example by means of a clutch.

The position of the slide 15 in the starting position determines the distance between the fold to be made and the trailing edge of the pliable material 2 which rests against the slide 15.

Optionally, the folding rollers 5 and 6 can each form a roller of a conveyor belt, in which case the folding-/nipping area 7 is formed by the outer surface portions of the two conveyor belts.

Figure 2:
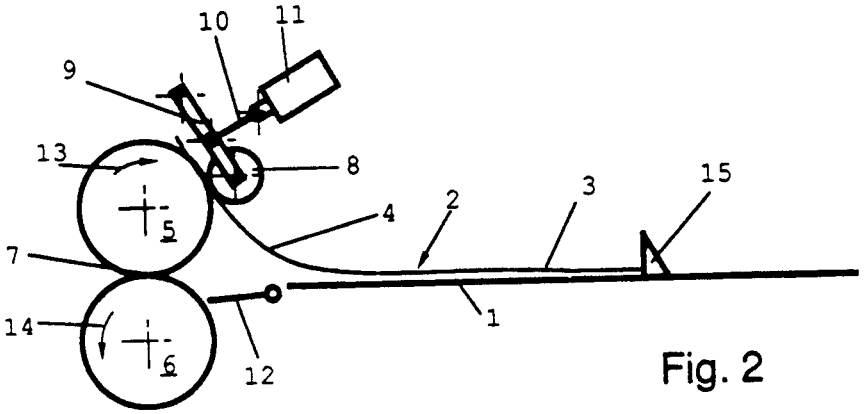

FIG. 2 shows the hold-down roller 8 in a position where it is pressed against the folding roller 5 by means of the electromagnet 11. The folding roller 5 engages the pliable material 2 so that the pliable material 2 is carried along by the rotation of the folding roller 5 and the portion 4 of the pliable material 2 which is bent out of the feeding plane 17 is further folded over. The feeding guide 12 is in a position where it is swung down so that it does not prevent the portion 4 of the pliable material 2 which is bent out of the feeding plane 17 from being folded over further.

Figure 3:
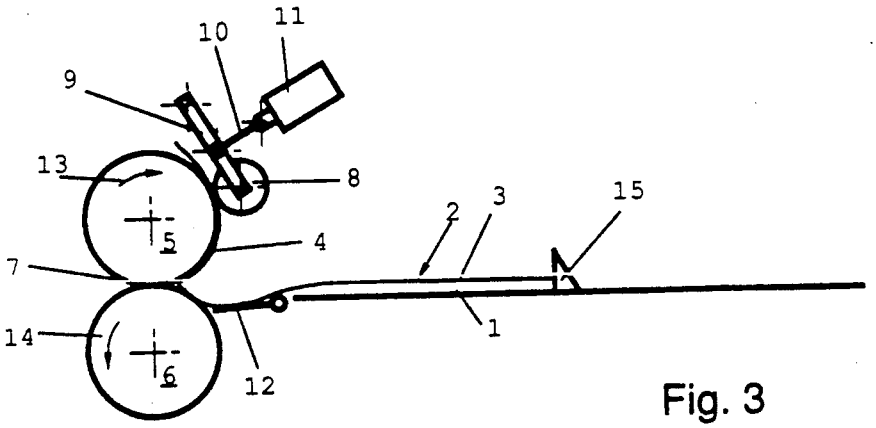

When said portion 4 of the pliable material 2 is folding over, the slide 15 is displaced towards the folding nip 7 so that the curve of the pliable material 2, whose radius is gradually reduced, is pressed against the folding rollers 5 and 6 and is drawn towards the folding nip 7 between the folding rollers 5 and 6, as shown in FIG. 3.

Figure 4:
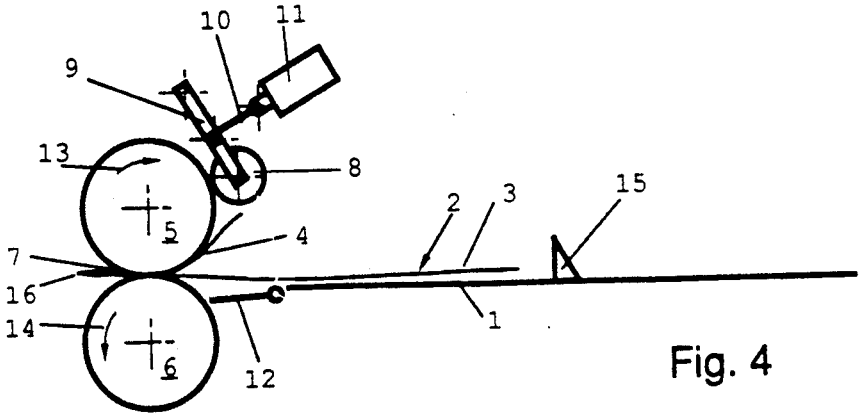

Upon passing the folding nip 7, the curve of the pliable material 2 is flattened so that a fold 16 is made therein. Then the pliable material 2 is conveyed further, as shown in FIG. 4. It is observed that the portion 3 of the pliable material 2, which is disposed in the feeding plane 17 at the stage shown in FIG. 2 is hardly bent, if at all, during the folding, so that relatively rigid elements, such as plastic identification cards and flat cardboard objects may be incorporated therein.

In virtue of the fact that the hold-down element is formed as a hold-down roller 8, the pliable material 2 can be kept fixed against the folding roller 5 upon displacement of the folding roller 5 without the hold-down element rotating along with the folding roller 5.

The slide 15 may be coupled to a control system which is adapted to operate the electromagnet 11 and the feeding guide 12 depending on the location of the slide 15 relative to the folding rollers 5 and 6 and on the required distance between the fold and the edge of the pliable material 2 remote from the folding rollers 5 and 6.

A further improved control of the location where the fold is made can be achieved by mounting the hold-down element for rotation about the centerline of the folding roller 5 along a path on the supply side of the folding roller 5 between a position where the hold-down element is opposite a segment of the folding roller 5 that is turned away from the feeding plane 17 and a position where the hold-down element is opposite a segment of that folding roller 5 that is turned towards that feeding plane 17, as shown in FIG. 5.

Preferably a rocker 21 is coupled to a shaft of the corresponding folding roller 5 Thus, the pivoting movement of the rocker 21, which is to take place each time the direction of rotation of the folding roller is reversed, can be driven in an easy manner. FIG. 7 shows the embodiment according to FIG. 5 in which the folding roller 5 comprises a shaft 35 and the clutch between the rocker 21 and the shaft 35 of the folding roller 5 is formed as a helical spring 33 clamped about said shaft.

According to the embodiments of the invention shown in FIGS. 5 and 7 the hold-down roller 8 is pressed against the folding roller 5 by means of two springs 36'' and the direction of rotation of at least the folding roller 5 corresponding with that hold-down roller 8 is reversible. When the pliable material is introduced, the hold-down roller 8 is pressed against the folding roller 5, with the folding roller 5 rotating in such a direction that the outer surface in the folding nip 7 moves in a direction opposite to the direction of supply. The pliable material can be carried along between and by the rotating folding roller 5 and the hold-down roller 8 rotating along with it. Accordingly, it is not necessary to provide means for lifting the hold-down roller 8 off the folding roller 5, while at the same time the simultaneous rotation of the two oppositely arranged rollers facilitates the introduction of the pliable material between them.

By adapting the hold-down roller 8 to be driven by means other than its outer surface, sheets can be prevented from sliding relatively to each other, particularly when the pliable material is composed of greater numbers of sheets. According to the embodiment of the invention shown in FIG. 7, the hold-down roller 8 is connected fixedly is under restraint from relative rotation, with a toothed driving wheel 25 which is driven in a fixed ratio corresponding with the effective circumference of the respective rollers 5 and 8. The toothed driving wheel 25 meshes with a correspondingly toothed driving wheel 26 which is connected, fixedly with the folding roller 5. Driving wheel 26 in turn meshes with a toothed driving wheel 27 which is connected fixedly with the folding roller 6. The folding rollers 5 and 6 are connected with toothed driving wheels 30 and 31, respectively, via couplings 28 and 29, respectively, said driving wheels being driven in one and the same direction. By engaging either coupling 30 or the other coupling 31, the direction of rotation of the folding rollers 5 and 6 can be set for the introduction or the folding of the pliable material.

One embodiment, particularly advantageous for reversing sheets, comprises a feed-through guide 23 mounted on the rocker 21, which guide 23 extends on the side of the hold-down element that is proximal to the feeding plane 17 (FIG. 5). It is adapted to conduct the initially trailing edge of the pliable material as a new leading edge to the folding/nipping area, there to be caught by the folding rollers. Further, when a fold is to be made in pliable material of which a portion is already folded, the feed-through guide 23 can prevent the portion already folded over from being bent back along the portion of the pliable material that is bent out of the feeding plane 17 when the latter portion is being folded over.

Provided at the side of the rocker 21 remote from the feeding plane 17 is a flap guide 24. This flap guide 24 can prevent an already folded-over portion of pliable material which is to be further folded from being folded back when a free end thereof passes the hold-down element in the direction of the feeding plane 17.

The embodiment shown in FIG. 5 further comprises feeding rollers 18 and 19 on opposite sides of the feeding plane 17 for supplying the pliable material 2 to the folding nip 7. Arranged above the feeding plane 17 is an eye 20 adapted to detect the passage of the edge of the pliable material remote from the folding rollers 5 and 6 for operating the drive of the folding rollers which carry along the pliable material. For setting the distance between the fold to be made and the edge of the pliable material remote from the folding rollers 5 and 6, the location of the eye 20 can be adjustable. Preferably, however, the eye 20 as well as the drive of the feeding rollers 18 and 19 is coupled to a control means which operates the drive of the folding rollers 5 and 6 after the feeding rollers 18 and 19 have gone through an angular displacement which is dependent upon the required distance between the fold to be made and the edge of the pliable material remote from the folding rollers 5 and 6.

The embodiment shown in FIG. 6 comprises two sets of folding rollers 5 and 6 as well as 5' and 6'. The folding rollers 5 and 6 arranged on opposite sides of the feeding plane upstream of the folding rollers 5' and 6' are at the same time feeding rollers for feeding pliable material into a subsequent starting position for a next fold to be made or for the pliable material to be reversed by means of the folding rollers 5' and 6'. The feeding plane is formed by coinciding first and second feeding planes F1, F2 located upstream and downstream, respectively, of the first roller pair 5, 6.

To provide the possibility of making folds in different directions, the feeding guide 32 is so constructed that it can be brought into two positions intersecting the extension of the feeding plane 17 and being substantially mirror-symmetrical relatively to that plane, there being provided at least one hold-down element on both one side of the feeding plane 17 and on the other side thereof. In accordance with the position of the feeding guide 32, a portion of the pliable material is bent out of the feeding plane 17 in the direction of that folding roller 5' or 6' which the feeding guide 32 is directed at.

What I claim is:

1. A method of folding a sheet, said method utilizing a first pair of diametrically opposite folding rollers, and a second pair of diametrically opposite folding rollers located downstream of said first roller pair, the rollers of said first roller pair forming a first nip therebetween and being located on opposite sides of a first feeding plane leading to said first roller pair, and the rollers of said second roller pair forming a second nip therebetween and being located on opposite sides of a second feeding plane extending from said first roller pair to said second roller pair, said first and second feeding planes being substantially coincident, said method comprising the steps of: arranging said sheet at said first roller pair such that a trailing portion of said sheet lies in said first feeding plane, and a leading portion of said sheet is bent out of said first feeding plane and is pressed against one roller of said first roller pair; pushing said sheet in a downstream direction to cause said bent upstream portion to enter said first nip; rotating said first roller pair as said sheet is advanced through said first nip such that a first fold is formed in said bent upstream portion to define a first-folded portion of said sheet; continuing to rotate said first roller pair to advance said first-folded portion in a downstream direction along said second feeding plane; guiding said sheet such that said first-folded portion is bent out of said second feeding plane and is pressed against a roller of said second roller pair; and rotating said second roller pair as said sheet is advanced through said second nip such that a second fold is formed in said sheet.

2. A method according to claim 1, wherein said guiding step comprises guiding said first-folded portion selectively to either side of said second feeding plane.

3. A method according to claim 1, wherein said arranging step includes pressing said leading portion against said one roller of said first roller pair by means of a hold-down roller driven at a peripheral speed equal to that of said one roller of said first roller pair.

4. A method according to claim 1 including the step of sensing a trailing edge of said sheet and signaling the location of said trailing edge to a control system which initiates said pushing step.

5. A method according to claim 4, wherein said sensing step is performed upstream of said first roller pair.

6. Apparatus for folding a sheet, comprising a first pair of diametrically opposite folding rollers, the rollers of said first roller pair forming a first nip therebetween and being located on opposite sides of a first feeding plane leading to said first roller pair, a second pair of diametrically opposite folding rollers disposed downstream of said first roller pair, the rollers of said second roller pair forming a second nip therebetween and being located on opposite sides of a second feeding plane extending from said first roller pair to said second roller pair, said first and second feeding planes being substantially coincident, a first movable feed guide located upstream of said first roller pair for positioning a leading portion of a sheet against a roller of said first roller pair so that said leading portion can be bent and fed through said first nip for forming therein a first fold and defining a first-folded portion of said sheet, said first roller pair being rotatable to advance said first-folded portion toward said second roller pair along said second feeding plane, a second movable feed guide disposed between said first and second roller pairs for positioning said first-folded portion against a roller of said second roller pair so that said first-folded portion can be bent and fed through said second nip for forming a second fold in said sheet, and a hold-down element disposed adjacent at least one respective roller of each of said first and second roller pairs for pressing said sheet against said respective rollers.

7. Apparatus according to claim 6, including said hold-down elements disposed adjacent both rollers of said second roller pair, said second movable feed guide being selectively movable between at least: a first position for guiding said first-folded portion between a first of said rollers of said second pair and its respective hold-down element, and a second position for guiding said first-folded portion between a second of said rollers of said second pair and its respective hold-down element.

8. Apparatus according to claim 6, wherein said hold-down elements comprise rollers.

9. Apparatus according to claim 6 including means for moving said hold-down elements toward and away from their respective rollers and for holding said hold-down elements in a position spaced from said respective rollers.

10. Apparatus according to claim 6, wherein one of said movable feed guides comprises a pivoting flap.

11. Apparatus according to claim 6 including a control mechanism comprising sensing means for sensing the location of a trailing edge of said sheet.

12. A method of folding pliable material in the form of assembled or single sheets of paper or similar relatively rigid material which may vary in quality and length, the folding taking place by means of folding rollers arranged approximately diametrically opposite to each other, substantially on either side of a feeding plane, starting from a position of the pliable material in which a part thereof lies in the feeding plane and a pair is bent out of said plane and wherein an arcuate part of the position of the pliable material bent out of the plane is bent further and is conducted to a folding/nipping area between the folding rollers where the folding rollers make the fold and wherein a trailing portion of the pliable material is fed in controlled fashion from the feeding plane, characterized in that the arcuate part of the pliable material is bent further and conducted to the folding/nipping area between the folding rollers by pressing the portion of the pliable material bent out of the feeding plane in at least one place against the closest folding roller and rotating said folding roller, the controlled feeding of the trailing portion being effected by pushing against the trailing edge thereof, while the located of said trailing edge is signaled to a control system, which starts the further folding over and conducting of the bent portion between the folding rollers, depending on the location of said trailing edge and the required distance between said trailing edge and the fold.

13. A folding device for folding pliable material in the form of assembled or single sheets of paper or similar relatively rigid material which may vary in quality and length, comprising a feeding plane for the pliable material, at least one pair of folding rollers arranged approximately diametrically opposite each other, substantially on either side of the feeding plane, said folding rollers having opposite outer surface portions forming a folding/nipping area in a position substantially in the feeding plane, a movable feeding guide adapted to intersect the feeding plane, and means for bending and conducting a bent portion of the pliable material towards the folding/nipping area, characterized in that the means for conducting the bent portion of the pliable material towards the folding/nipping area are formed as at least one of said folding rollers, and a mechanism for bringing and retaining the hold-down element in a position spaced from the folding roller.

14. A folding device for folding pliable material in the form of assembled or single sheets of paper or similar relatively rigid material which may vary in quality and length, comprising a feeding plane for the pliable material, at least one pair of folding rollers arranged approximately diametrically opposite each other, substantially on either side of the feeding plane, said folding rollers having opposite outer surface portions forming a folding/nipping area in a position substantially in the feeding plane, a movable feeding guide adapted to intersect the feeding plane, and means for bending and conducting a bent portion of the pliable material towards the folding/nipping area, characterized in that the means for conducting the bent portion of the pliable material towards the folding/nipping area are formed as at least one hold-down element adapted to exert a pressure force on one of said folding rollers, said hold-down element being suspended in a rocking device pivoting about the axis of the folding roller along a track at the feeding side of the folding roller, between a position wherein the hold-down element is opposite a segment of the folding roller away from the feeding plane and a position wherein the hold-down element is opposite a segment of said folding roller facing said feeding plane.

15. A folding device according to claim 14, wherein the rocking device is coupled with a shaft of the corresponding folding roller.

16. A folding device according to claim 14, wherein a feed-through guide is attached to the rocking device and extends at the side of the hold-down element facing the feeding plane.

17. A folding device for folding pliable material in the form of assembled or single sheets of paper or similar relatively rigid material which may vary in quality and length, comprising a feeding plane for the pliable material, at least one pair of folding rollers arranged approximately diametrically opposite each other, substantially on either side of the feeding plane, said folding rollers having opposite outer surface portions forming a folding/nipping area in a position substantially in the feeding plane, a movable feeding guide adapted to intersect the feeding plane, and means for bending and conducting a bent portion of the pliable material towards the folding/nipping area, characterized in that the means for conducting the bent portion of the pliable material towards the folding/nipping area are formed as at least one hold-down element adapted to exert a pressure force on one of said folding rollers, a control system, a stop movable along the feeding plane and means for signaling the position of the stop to the control system.

18. A folding device for folding pliable material in the form of assembled or single sheets of paper or similar relatively rigid material which may vary in quality and length, comprising a feeding plane for the pliable material, at least one pair of folding rollers arranged approximately diametrically opposite each other, substantially on either side of the feeding plane, said folding rollers having opposite outer surface portions forming a folding/nipping area in a position substantially in the feeding plane, a movable feeding guide adapted to intersect the feeding plane, and means for bending and conducting a bent portion of the pliable material towards the folding/nipping area, characterized in that the means for conducting the bent portion of the pliable material towards the folding/nipping area are formed as at least one hold-down element adapted to exert a pressure force on one of said folding rollers, a control system, at least one pair of feed rollers and means for signaling displacements of at least one of the feed rollers to the control system.

* * * * *